US008523549B2

(12) United States Patent
Casanova et al.

(10) Patent No.: US 8,523,549 B2
(45) Date of Patent: Sep. 3, 2013

(54) SYSTEM FOR IN-SITU MAKING SUBSTANTIALLY VERTICAL BUILDING WORKS

(76) Inventors: Alfio Leonardo Casanova, Lugano (CH); Michele Casanova, Sorengo (CH)

( * ) Notice: Subject to any disclaimer, the term of this patent is extended or adjusted under 35 U.S.C. 154(b) by 0 days.

(21) Appl. No.: 13/331,877

(22) Filed: Dec. 20, 2011

(65) Prior Publication Data

US 2012/0085592 A1 Apr. 12, 2012

Related U.S. Application Data

(63) Continuation of application No. PCT/EP2009/004983, filed on Jul. 9, 2009.

(51) Int. Cl.
*E04G 11/00* (2006.01)

(52) U.S. Cl.
USPC ..... 425/63; 425/65; 249/20; 249/24; 249/93; 249/189

(58) Field of Classification Search
USPC ..... 425/63–65; 249/20, 24, 29, 93, 249/188–189; 264/33–34, 333
See application file for complete search history.

(56) References Cited

U.S. PATENT DOCUMENTS

| | | | | | |
|---|---|---|---|---|---|
| 2,298,839 | A | * | 10/1942 | Porter | 425/63 |
| 2,723,437 | A | * | 11/1955 | Ghormley et al. | 249/20 |
| 3,377,669 | A | * | 4/1968 | Burgess | 425/59 |
| 3,991,969 | A | * | 11/1976 | Oxyer | 249/20 |
| 4,060,358 | A | * | 11/1977 | Fougea | 425/65 |
| 4,140,466 | A | | 2/1979 | Snow et al. | |
| 4,253,810 | A | * | 3/1981 | Bezhanov et al. | 425/64 |
| 4,784,365 | A | * | 11/1988 | Scott | 249/21 |
| 5,086,605 | A | * | 2/1992 | Tzincoca | 52/745.13 |
| 5,109,953 | A | * | 5/1992 | Mathis | 182/129 |
| 6,082,059 | A | * | 7/2000 | Loomans | 52/143 |
| 6,158,710 | A | * | 12/2000 | Matthews | 249/34 |
| 7,513,480 | B2 | * | 4/2009 | Bergaretxe et al. | 249/20 |
| 2003/0034576 | A1 | * | 2/2003 | Russell | 264/33 |
| 2005/0268818 | A1 | * | 12/2005 | Colavito et al. | 106/661 |
| 2010/0038518 | A1 | * | 2/2010 | Schwoerer | 249/20 |

FOREIGN PATENT DOCUMENTS

| | | | | |
|---|---|---|---|---|
| CS | 213 802 | B1 | | 4/1982 |
| DE | 102 431 | A1 | | 12/1973 |
| DE | 24 23 556 | A1 | | 11/1975 |
| EP | 18014 | A2 | * | 10/1980 |
| EP | 471870 | A1 | * | 2/1992 |
| FR | 1564078 | A | | 4/1969 |
| FR | 2 609 745 | A1 | | 7/1988 |
| GB | 2 046 341 | A | | 11/1980 |
| JP | 05133097 | A | * | 5/1993 |

(Continued)

OTHER PUBLICATIONS

Translation of DE 2423556.*

(Continued)

*Primary Examiner* — Dimple Bodawala
(74) *Attorney, Agent, or Firm* — Dickstein Shapiro LLP

(57) ABSTRACT

Scaffold systems (SMV) to make substantially vertical building works, with sensitive time and manpower savings. In an advantageous embodiment, a scaffold is formed by a couple of modular semi-scaffolds which face each other, a semi-scaffold being placed in a cis-position over the work under erection and the other semi-scaffold is set in the trans-position.

7 Claims, 8 Drawing Sheets

(56) References Cited

FOREIGN PATENT DOCUMENTS

| | | | | |
|---|---|---|---|---|
| JP | 05256021 | A | * | 10/1993 |
| JP | 06240864 | A | * | 8/1994 |
| WO | WO 2010/108521 | A1 | | 9/2010 |

OTHER PUBLICATIONS

Translation of FR 1564078.*
Translation of JP 05-133097.*

* cited by examiner

SYSTEM FOR IN-SITU MAKING SUBSTANTIALLY VERTICAL BUILDING WORKS

This is a continuation of International Application No. PCT/EP2009/004983, filed on Jul. 9, 2009, the disclosure of which is herein incorporated by reference.

BACKGROUND AND FIELD OF THE INVENTION

The present invention concerns systems to make in-situ substantially vertical building works with relevant time-, manpower-, and material-savings.

In a particularly effective and advantageous embodiment the invention relates to a system to make in-situ building works of prevailingly vertical heights, with the aid of preferably composite scaffolds i.e. consisting of modular elementary scaffold couples (or semi-scaffolds), said system being dimensionally adjustable and easily movable as an integral body.

In a recent WO 2010/10851 (International Application No. PCT/EP2009/002280 filed on Mar. 27, 2009) Applicant has illustrated the general background of the present construction techniques of big, mean and short size buildings and has proposed as a solution idea, a particularly efficacious system of scaffolding and hollow tubes supports for substantially horizontal building works for home or industrial use.

Said system comprises: —a first sub-system S1 consisting of a horizontal platform adjustable along the two planar dimensions (X-Y), i.e. in length and width; —a second sub-system S2 of first interface, involving means to couple said sub-system S1 with a successive sub-system S3; —a third sub-system S3 acting as adjustable superior carrying structure; —a fourth sub-system S4 of second interface between said S3 and S5; —and a fifth inferior sub-system S5 to determine the stationary work conditions and the non-stationary moving conditions.

As anticipated the system according to the precedent International Patent Application PCT/EP2009/002280 (the description of which is incorporated by reference herein) is essentially concerned with platforms for horizontal expanding construction works (SMI).

In the continuation of his researches and experiments, Applicant has succeeded, (not without surprise), to bring about a system which fills the gaps and lacunas existing in the field of the substantially vertical building works (SMV) whereby, among the several advantages, the necessity is eliminated to make recourse to wood or metal plankings which were vertically in-situ assembled with the aid of scaffoldings and buttress forming structures generally different from the rectangular form.

We should emblematically recall the conventional vertical pillars for the in-situ embodiment of which at least four vertically extending plankings were needed that had to be each other nailed and bolted, and supported generally by buttresses of, without doubt, complexity.

After the concrete jet, said complex scaffolds of several walls had to be unbolted and inspected to recover the still useful material (generally 30-40%) to be again nailed with fresh plankings, etc.

It is true that for the common walls only two plankings are needed however the major problems remain because the mounting and demounting times are still long and the requested manpower (mainly the carpenters) must still have skill and experience.

SUMMARY OF THE INVENTION

A first object of the present invention is to provide a system of vertical scaffolding substantially "preformed" in the sense that the "classic planking" is adequately substituted with at least one wall forming element having the major dimension in the "Z" direction. Another object of the invention is to provide a vertical scaffolding system substantially consisting of couples of modular "elementary" scaffolds which are adjustable in height and width and are easily movable without needing de-mountings and re-mountings and consequently assure working time-and-manpower-savings as well as practically no loss of the material which was normally damaged in the course of the conventional dismantles, ri-assemblings and displacements.

Therefore in a first embodiment the system (SMV) according to the invention consists of couples of elementary scaffolds placed in face to face position, the distance between the components of said couple being adjustable according to the building work dimensions.

The modularity of said elementary scaffolds makes it possible to produce building works not only of large height (axis Z) but also of large length (axis X) by putting in situ a large number of modular elementary couple systems.

The main features and characteristics of the system according to the present invention are recited in the claims at the end of this description, which can be also considered herewith incorporated.

BRIEF DESCRIPTION OF THE ACCOMPANYING DRAWINGS

The various features and advantages of the system according to the invention will more cleary appear from the following description of the preferred (illustrative and not limitative) embodiments represented in the accompanying drawings in which:

FIGS. 1A and 1B are schematic, partial perspective views of an advantageous and therefore preferred embodiment of the (SMV) system according to the invention, wherein the scaffold forming elements are fixed to a box-like support having substantially rectangular cross-section; said views of FIGS. 1A and 1B can be "imagined" as obtained by looking at said element S4 (preferably shown in form of a long slab of metallic plate, preferably of steel sheet), in the direction of arrow A in FIG. 4B respectively on the same element S4 (LA) of FIG. 1A, but rotated of about 180° in the anti-clockwise direction;

FIG. 2 is a perspective view substantially similar to that of FIG. 1A with the difference that FIG. 2 is upwards exploded and represents a second embodiment in which said sub-system S4 (still in the form of a long metallic plate slab LA) is fixed to a buttress structure S'2, is activated by fine raising organs OS and OS', and has a lower sub-system S3' substantially similar to that of the rectangular cage (SMV) of FIGS. 1A, 1B . . . 4A, 4B consisting of a crossbar T7 with wheels 32 (and the relevant pivots 30, 33) and of two short reversed legs B1 and B2 whose superior ends penetrate in and slide within the lower ends of the vertical upright M1';

Figure 4B:
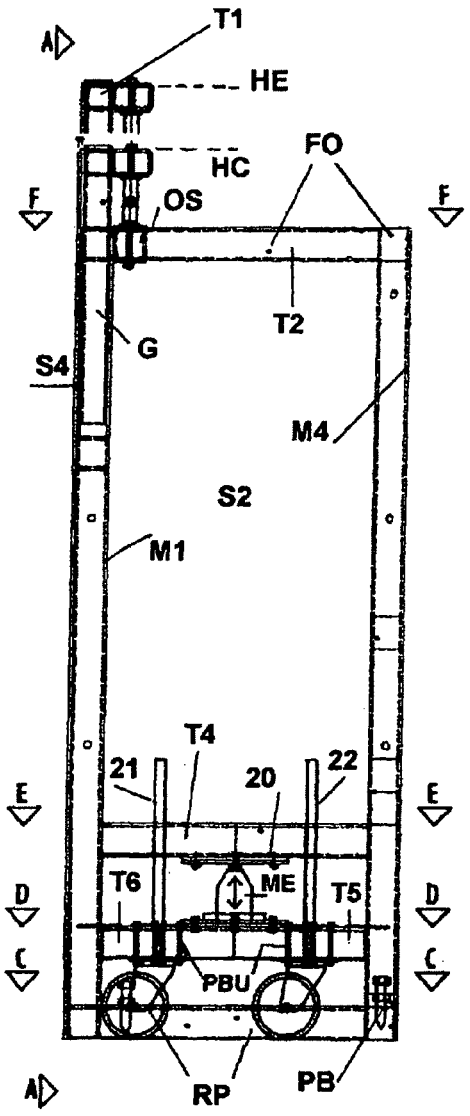
FIGS. 4A and 4B are cross-section views of the (SMV) of FIG. 3, with a front plane (FIG. 4A) respectively lateral plane (FIG. 4B)
Figure 5D:
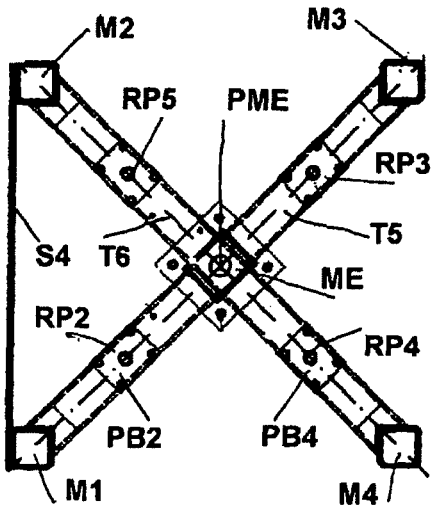
Figure 5F:
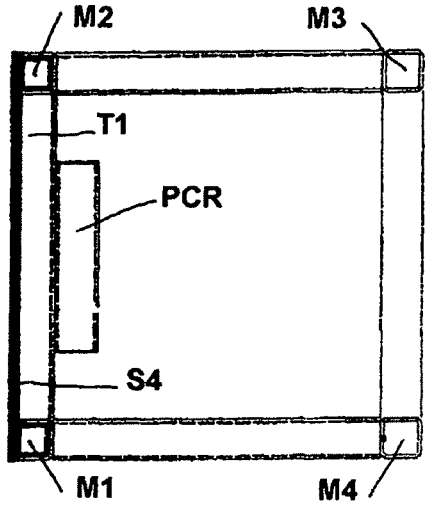
Figure 5C:
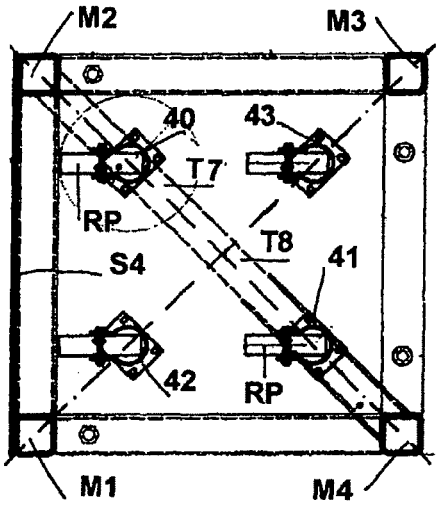
Figure 5E:
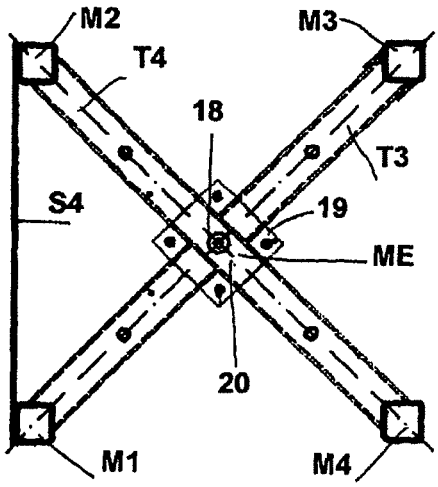
Figure 6:
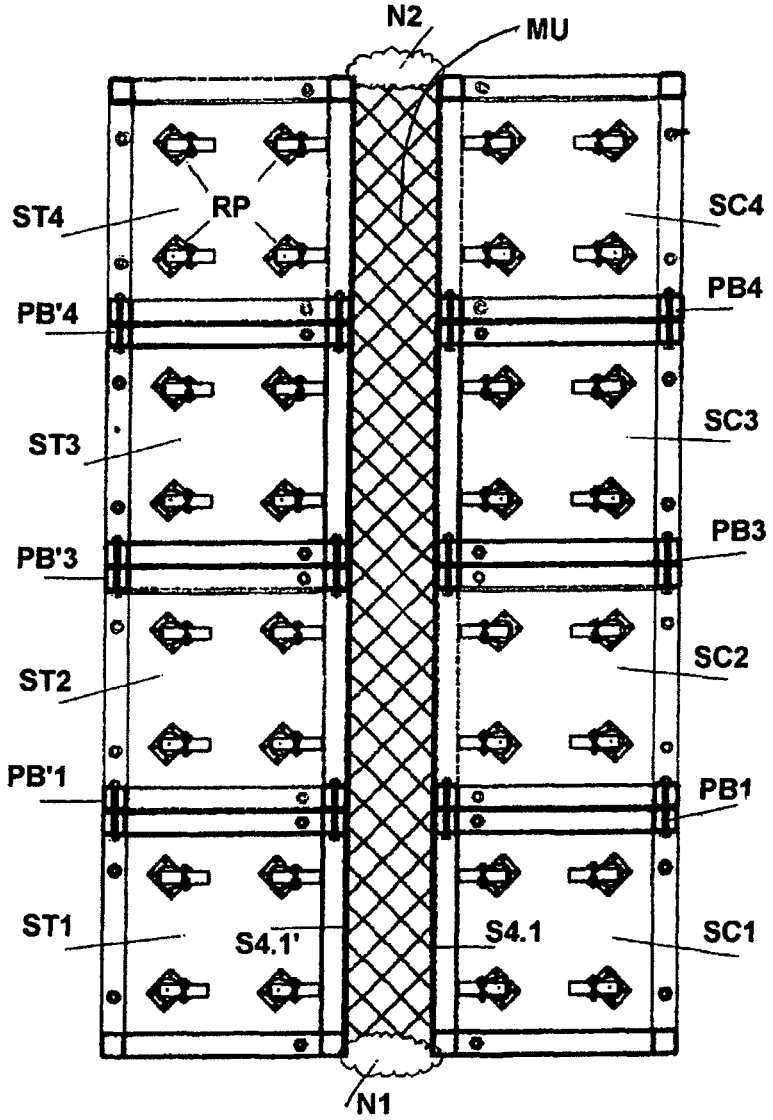
Figure 7:
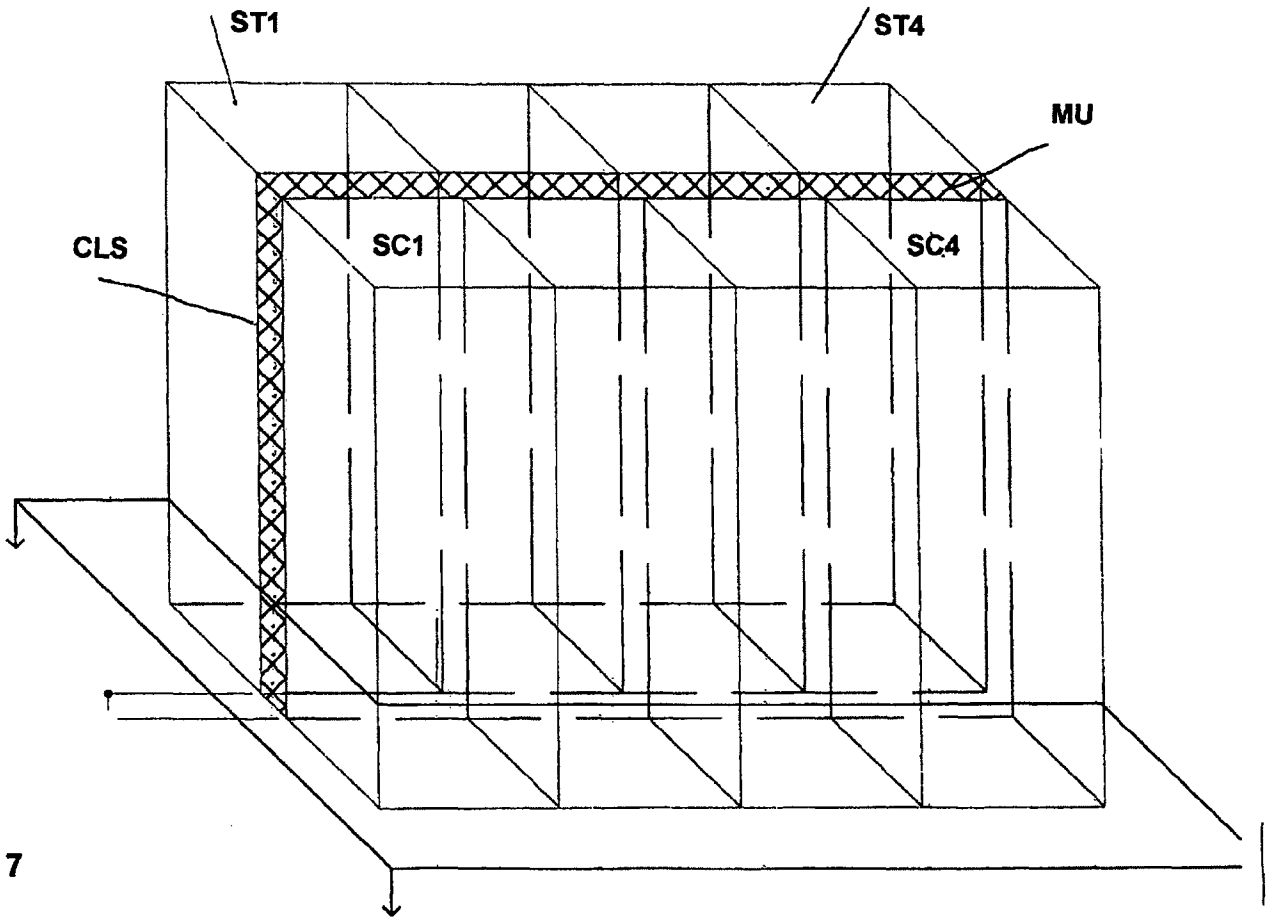

FIGS. 5C, 5D, 5E, 5F are top views of the cross sections with horizontal planes having the trace lines C-C, D-D, E-E, F-F indicated in FIG. 4B, each letter C, D, E, F associated to number 5 being intended to easily recall its respective cross-section line whereby "FIG. 5C reminds line C-C, FIG. 5D recalls line D-D, FIG. 5E line E-E and FIG. 5F line F-F", FIG. 5A and FIG. 5B being absent because of the absence of cross-lines A-A,B-B in FIG. 4B;

FIG. 6 is a top view of a complex system having (as an illustrative example) eight systems SMV, four systems SC1-SC4 in CIS-position over the building work under erection (f.i. a high and long wall MU) and four systems ST1-ST4 in Trans-position, said four CIS systems namely SC1-SC4 being fixed with the aid of pivots (and bolts) PB'1-PB'4; systems SC1-SC4 are placed face-to-face to ST1-ST4 whereby the respective sub-systems S4.1-S4.4 form scaffolds with the opposite S4.1'-S4.4'; and FIG. 7 is the axonometric scheme of the scaffolds of FIG. 6 in the position to receive the concrete jet CLS.

The term CIS and TRANS are here used in analogy to "Cis-Alpine" respectively "Trans-Alpine", i.e. Cis-(Alpine) means the position of lands and bodies "AT THIS SIDE" of the Alps whereas Trans-(Alpine) means the position "beyond (at the other side) of the Alps".

DETAILED DESCRIPTION OF THE PREFERRED EMBODIMENTS OF THE INVENTION

It is convenient to put forward that the system (SMV) to make VERTICAL building works according to the invention follows the birth of the first horizontal system (SMI) according to said PCT International Patent Application PCT/EP2009/002280 whereby the vertical system SMV cannot but follow closely some characteristics of the first SMI, whereby also SMV is articulated in sub-systems (four in SMV and five in SMI); the first sub-system S1 has the task to finely establish the optimal height (maximal HE and minimal HC in FIG. 3) of SMV and is activated with the aid of a fine raising organ OS which in this case is preferably a car jack type CRIK (FIG. 3) and allows the closing of SMV f.i. under a possible concrete slab (not shown) made before positioning and activating the said SMV components. The second sub-system S2 is the central structure support of all the other sub-systems S1, S3 and S4, sub-system S4 being now the invention characterizing element consisting of a long metallic sheet plate fixed (at least) to the support S2 frontal face "at this side, CIS, of wall MU" which is one of the two scaffold forming elements, the other semi-scaffold being placed TRANS "at the other side" (beyond) the wall on a second similar system SMV' facing SMV. During the working breaks SMV and its facing SMV' are each moved as an integral body without the need of de-mountings and re-mountings, by acting on the inferior sub-system S3 provided with twirling wheels RP and with another raising organ preferably of the jackscrew type ME controlled through a lever L.

For the structure of support of sub-systems S1, S2, S3 it has been maintained the structure advantageously experimented in the prior horizontal system SMI, of the hollow uprights, which penetrate and slide within each other. The dimensions of the steel base tubular elements can be of 1.00×1.00 M1, however they depend on form and size of the building work piece.

In the back portions the couplings can be made with full steel beams to have a weight sufficient to balance SMV. When it is not possible to form the scaffolds with the aid of two facing elements because of insufficient space, an additional element with counter-scaffold can be utilized which simply consists of a framework of tubes made of the same plates having different diameter.

In substance the SMV system according to the present invention (even if apparently inspired by precedent SMI) involves now sub-systems functionally and numerically different from those according to said SMI, in which SMV:

- S1 is the upper vertically highest sub-system to finely adjust the top height of SMV, f.i. for the closure under a not-shown, previously implanted concrete slab;
- S2 is the master structure to support and articulate said superior sub-system S1 and said inferior sub-system S3;
- S3 is the lowest sub-system which can take two configurations i.e. that of support and stationary fixation to the ground during the system work, and that of movement on the pirouetting wheels of the whole SMV as an integral body;
- S4 is a scaffold forming element (to be possibly called semi-scaffold) which is typically fixed to at least one face of the carrying structure S3.

Figure 2:
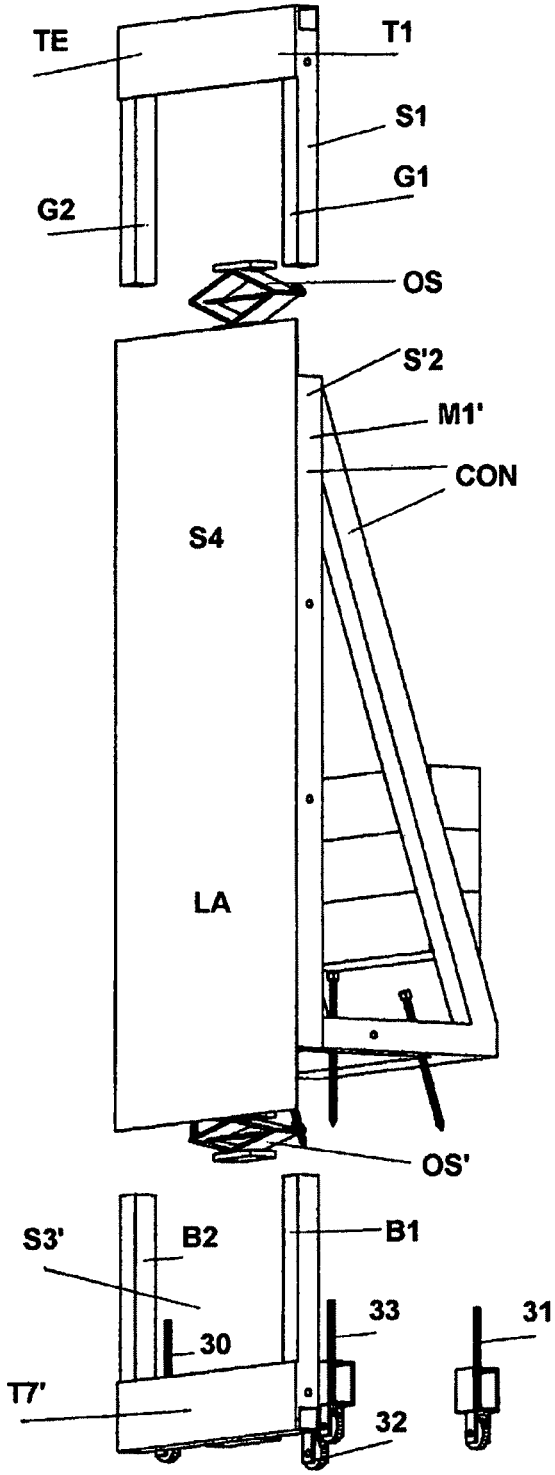
Figure 3:
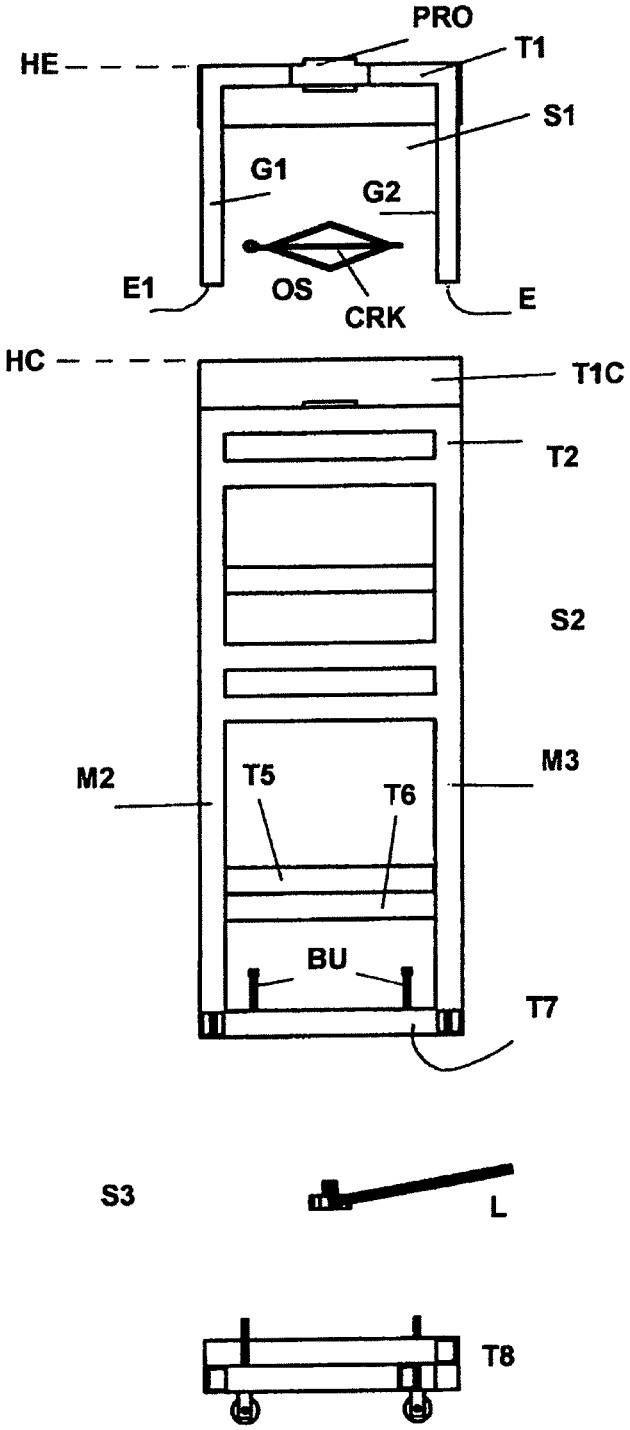
FIG. 3 is a front exploded view on the back of the (SMV) system according to arrow FR of FIG. 1A, or the arrow FR' of FIG. 1B.

In detail, in the preferred embodiment shown in the accompanying drawings in particular in FIGS. 2 and 3, exploded view of the buttress, respectively cage system SMV, the superior sub-system S1 comprises a frame with a top cross-bar T1 having an inwardly protuberance PRO which is moved by a fine raising organ OS, preferably a pantograph car jack CRK.

Figure 1A:
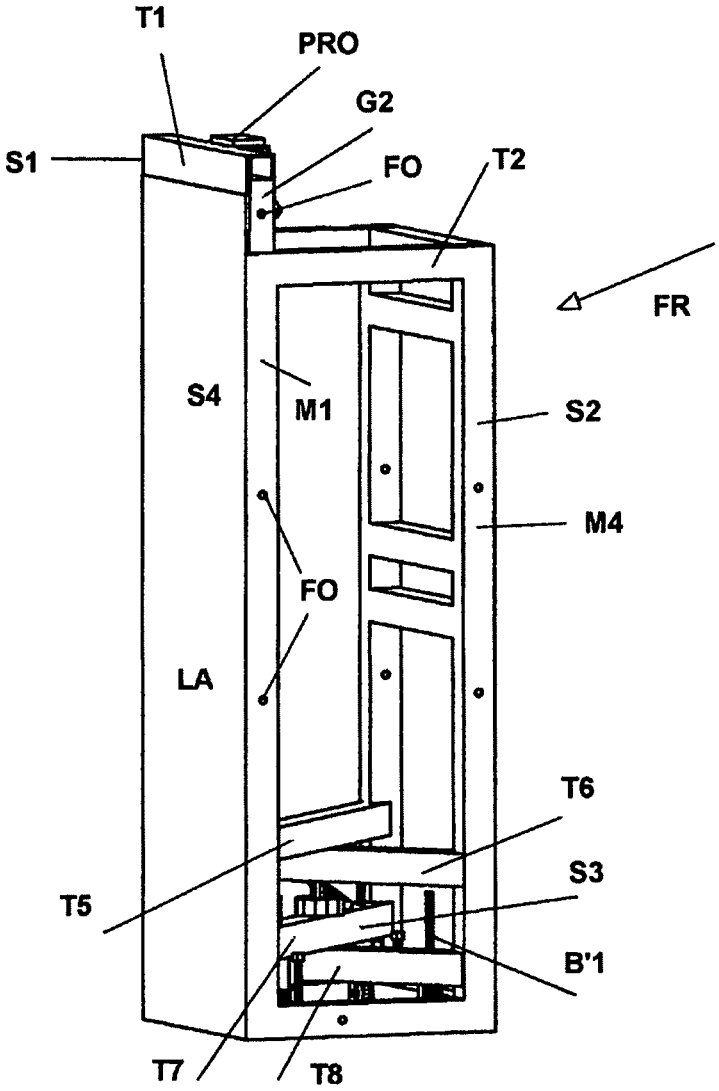

In the FIGS. 1 and 1A said cross-bar is in the compacted position whereas in the FIGS. 2 and 3 it is in the raised, i.e. in the position dictated by the fine raising organ CRK.

The support sub-system S2 of FIGS. 1, 1A, 3 etc. is to be "imagined" as a four face parallelepiped, each face consisting of two of the four up-rights (M1, M2, M3, M4) stiffened by cross-bars (T1, T2, T3, T4).

Figure 1B:
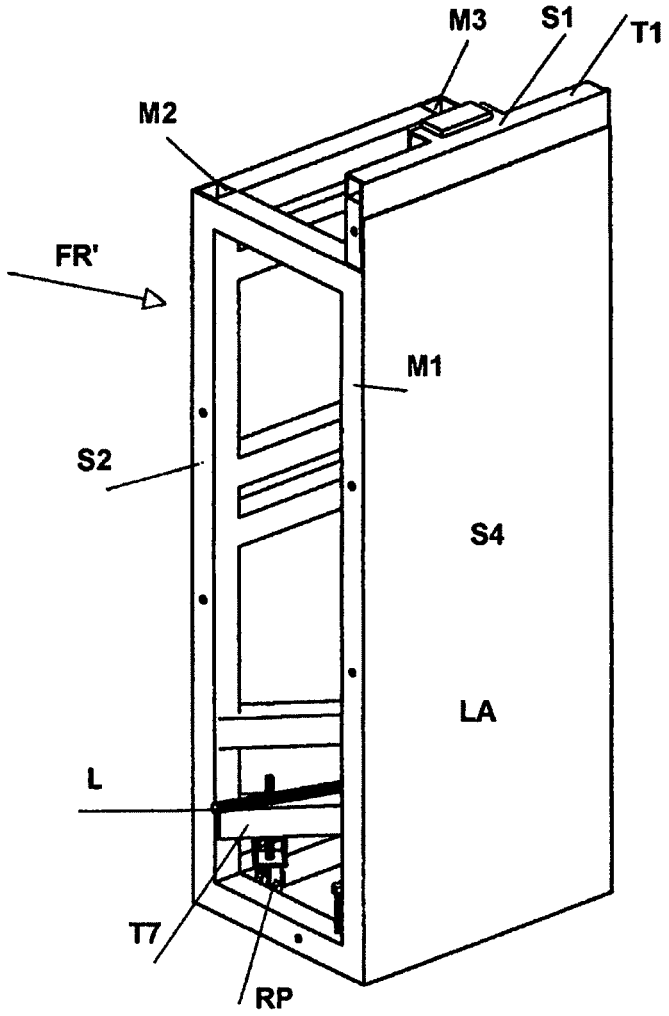
Figure 4A:
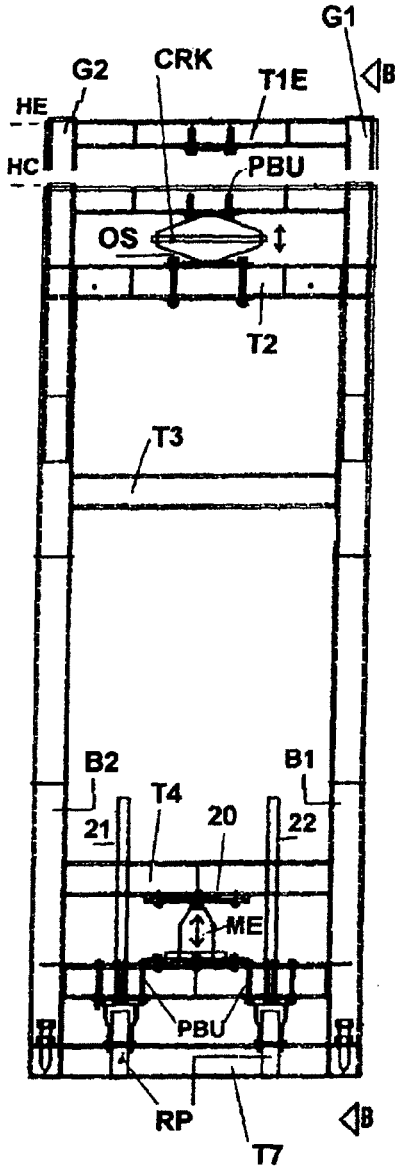

In FIGS. 4A and 4B the cross-sections of FIGS. 1A and 1B respectively of FIG. 3 with vertical planes, i.e. planes orthogonal to the drawing sheet, are shown.

In FIG. 4A it can be seen the head sub-system S1 which, as anticipated, consists of a frame (with an open bottom) having the superior raising cross-bar T1 and two of the four legs G1, G2 (G3 and G4 being not shown because are hidden). Said bar T1 is preferably made of sheet material with protuberance PRO on which goes to act the raising organ OS in this case a pantograph car jack as the upwards displacements of T1 (up to T1E) are small and require fine strokes. The inferior ends E, E1 (E2, E3) of said legs G1-G2 (G3 and G4) penetrate and slide within the top ends of T2 of S2.

As anticipated, in FIGS. 2, 3 and 4 are shown the top position HE which T1 reaches in the exploded configuration, and the compact position of the minimal height HC. The displacements of S2 are made by the sliding of legs G1 and G2 within the vertical tubes M1-M4 of major (or minor) diameter.

FIG. 5F (top view of the cross-section with the plane having the trace line F-F- in FIG. 4B) shows the cross-sections of uprights M1-M4 and the cross-bar T2 between M1 and M2 to which is typically fixed the sub-system. S4, i.e. the metallic plate long piece, whose surface has been submitted to surface treatment with anti-incrustation products.

FIG. 5F shows also the absence of cross-bar T1' in correspondence to line F-F- whereas it is clearly seen the tubular plate PCR on which rests the car jack, said plate having preferably the dimensions 100×100×8.

FIG. 5E (view on the cross-section having trace line E-E- of FIG. 4B) shows the uprights M1-M2 and M3-M4 stiffened by the couple of diagonal beams T3-T4 carrying in their central overlapping zone 18 a plate 19 with the seat 20 of the piston (non shown) of jack ME; in this case the typical plate LA of sub-system S4 is applied directly on the external face created by the two uprights M1-M2. No external cross-bars between M2 and M3, M3-M4 and M4-M1 are to be seen in correspondence of the line E-E.

FIG. 5D (view on the cross-section with the plane having the trace line D-D) shows the presence of the two crossing beams T5 and T6 which have the double function to accommodate the base of jack ME as well as the plates for fixing to said beams (f.i. with the aid of bolts of the type MA10 and MA12) the pirouetting wheels RP2-RP3 and RP4-RP5. Adequate pivots and bolts (not shown in order to avoid further complications to the drawings) connect and fix the axles of said two couples of twirling wheels RP5-RP6 to said diagonal beams T5-T6. There are no cross-bars between M1-M4 and M2-M3 in correspondence of plane having line D-D as trace.

Finally the view (in FIG. 5C) of the cross-section with plane C-C shows beams T7 and T8 carrying the couple of plates 40-41 and 42-43 to accommodate shafts, pivots, and bolts associated to the couples of twirling wheels RP.

Preferably and on the basis of the optimal experimental results obtained with the precedent SMI, the structures of the present SMV can be considered substantially inspired by the structures described in the Applicant's above mentioned PCT-Application and, above all, can be embodied in various configurations whereby they can be considered as unrelated to the main solution idea.

To testify the great versatility of the modular SMV systems, in the FIGS. 6 and 7 is schematically shown the particular case of the assembly of eight SMV units according to the present invention for the erection of a high and long building master wall MU.

The f.i. eights units SMV are placed in two group of four systems, one group SC1-SC4 in CIS-position over to the building work MU in course of erection, and the other group ST1-ST4 in Trans-position, the semi-scaffolds of one group facing those of the other group bringing about two lines of semi-scaffolds CIS and of semi-scaffold TRANS set at a transversal distance (in FIG. 7 equal to the thickness of the wall MU) easily adjustable according to the works under erection. The two narrow lateral ends N1 and N2 of MU can be closed by simple planking or other conventional means.

The quick, compact inexpensive formation, of maxi-scaffolds of this type is due to the modularity and "movability" of the integral body components as well as to the predisposition of holes FO for the screws, bolts, pivots and the like in said uprights and cross-bars.

Maxi-and-mini-scaffold systems of high versatility are obtained. According to a feature of the invention said versatility can be enhanced by applying more than one plate LA of S4 on the faces of the cage supports S2 as well as by using adjustable pivots, bolts, screw and the like to slightly move the panels LA over the walls and/or the facing scaffolds.

Two plates LA (S4) fixed to two orthogonal faces of cage support S2 would be convenient for walls MU formed by two wall portions forming an angle of 90°.

For scruple of illustrative clarity the invention has been described will particular reference to the embodiments shown in the accompanying drawings; however this invention cannot be considered as restricted to said embodiment but it is to be intended as comprising all changes, substitutions, additions and the like which if, being in the hand reach of the field mean technical expert, fall naturally within the scope of the following claims.

What is claimed is:

1. A building system for erecting a wall extended in a vertical direction, the building system comprising:

at least two scaffold-forming elements, each of the scaffold-forming elements being modular, specular, space adjustable, and movable as an integral body, without needing de-mounting and re-mounting; and wherein each of the scaffold-forming elements includes:

a first superior subsystem (S1) comprises a frame with top cross-bar (T1) having an inwardly protuberance (PRO), which is configured to cover and adjust total height of the scaffold-forming element by a vertical sliding movement under the action of an upper jack, and also adapted for closing the scaffold-forming element under a horizontal slab, by pushing upwardly against the slab;

a second carrier subsystem (S2) which is configured to slide upwardly under the action of a lower jack, the second subsystem being located at a central portion of the scaffold-forming element;

a third subsystem (S3) is adapted for supporting the scaffold-forming element in a first stationary configuration, in which the third subsystem is located beneath the second carrier subsystem, and in a second configuration in which the scaffold-forming element moves as an integral body; and a fourth subsystem (S4) including a prevailingly vertical body which is configured to form and act as a semi-scaffold fixed to at least a face of said second carrier subsystem and facing the extended wall; and wherein the semi-scaffold of one of the scaffold-forming elements is separate from a corresponding semi-scaffold of another one of the scaffold-forming elements located on another side of the extended wall.

2. The system according to claim 1, wherein each first subsystem includes a frame provided with legs constituted of tubular components having different widths.

3. The system according to claim 1, wherein each second subsystem includes tubular uprights that have superior ends, and legs that have inferior ends, and wherein the superior ends are slidable with respect to the corresponding first subsystem, and the inferior ends are slidable with respect to the corresponding third subsystem.

4. The system according to claim 1, wherein each fourth subsystem includes a first metallic plate body preferably coated with detaching and sliding chemical products which inhibit the formation of incrustations of mixtures based on cement, sand, lime and the like, and wherein said body acts as a first wall.

5. The system according to claim 4, further comprising a second coated plate body that is placed in front of the corresponding first body, the distance between said two bodies being substantially equal to the thickness of the wall.

6. The system according to claim 5, wherein each of the facing bodies is associated with a corresponding one of the scaffold-forming elements.

7. The system of claim 1, wherein a first series of said scaffold-forming elements, connected to each other, is placed in a CIS position relative to said wall, and a second series of said scaffold-forming elements, connected to each other, is placed in a trans position, such that the corresponding fourth subsystems, including metal sheets, face each other.

* * * * *